United States Patent [19]

Weiler et al.

[11] 3,938,950

[45] Feb. 17, 1976

[54] STRIPPING APPARATUS

[75] Inventors: Ernest A. Weiler, Rochester; Rabin Moser, Fairport, both of N.Y.

[73] Assignee: Xerox Corporation, Stamford, Conn.

[22] Filed: Mar. 14, 1974

[21] Appl. No.: 451,311

[52] U.S. Cl. ..... 432/59; 118/245; 271/DIG. 2; 271/80

[51] Int. Cl.[2] ..... B65H 29/56

[58] Field of Search ..... 271/80, 174, DIG. 2; 355/3 R, 14; 118/245; 432/60, 59

[56] References Cited

UNITED STATES PATENTS

| | | | |
|---|---|---|---|
| 1,737,616 | 12/1929 | Saatman | 271/DIG. 2 |
| 1,842,063 | 1/1932 | Becker | 271/DIG. 2 |
| 2,184,229 | 12/1939 | Spiess | 271/DIG. 2 |
| 2,211,766 | 8/1940 | Brown | 271/DIG. 2 |
| 2,348,355 | 5/1944 | Miller | 271/DIG. 2 |
| 2,844,372 | 7/1958 | Liebenow et al. | 271/80 X |
| 3,346,253 | 10/1967 | Paschke | 271/36 |
| 3,450,402 | 6/1969 | Weiler | 271/80 |
| 3,727,912 | 4/1973 | Vos | 271/DIG. 2 |
| 3,844,252 | 10/1974 | Thettu | 432/60 |

*Primary Examiner*—Evon C. Blunk
*Assistant Examiner*—Robert Saifer

[57] ABSTRACT

Stripping apparatus for stripping copy sheets bearing electrostatic developed images from a heated pressure fusing roll after fusing of the images to paper sheets. The stripping apparatus comprises a flexible blade member supported by a retaining device and positioned into contact with the heated fusing roll surface. The tip of the blade has a hollow ground edge of a radius slightly greater than the fuser roll. The blade is slideably positioned to enable lateral expansion axially relative to the retaining device. A modification of the stripping device consists of a comb design with blade and retaining members having inter-locking tines.

5 Claims, 3 Drawing Figures

STRIPPING APPARATUS

This invention relates generally to a xerographic copying apparatus and more particularly to an improved stripping apparatus for stripping copy sheets from a heated pressure roll fuser apparatus used to fix electroscopic toner material to paper sheets.

In the process of xerography, the light image of an original to be copied is typically recorded in the form of a latent electrostatic image upon a photosensitive member with subsequent rendering of the latent image visible by the application of electroscopic marking particles, commonly referred to as toner. The visual image can either be fixed directly upon the photosensitive member or transferred from the member to a sheet of plain paper with subsequent affixing of the image thereto.

One approach for fixing or fusing of electroscopic toner particles onto paper support material has been to pass the paper support material with toner images thereon between a pair of opposed roller members at least one of which is internally heated. Occassionally toner particles will be offset to the fuser roll for various reasons. In such a case toner particles may be transferred to the surface of the fuser with subsequent transfer to the backup roll during periods of time when no paper is in the nip. It will be appreciated that these toner particles can then be retransferred to the paper with an accompanying degradation of the quality of copies being produced. In one of the arrangements for minimizing the offsetting problem a release agent such as silicone oil is applied to the fuser roll.

In another arrangement metals or other suitable materials are used as fuser roll surfaces employing release agents which through chemical reaction of the oxidized release agent and the metal oxide of the fuser roll provide a suitable release coating during the fusing operation, as described in copending application Ser. No. 383,231 filed July 27, 1973, and commonly assigned with the instant application The removal of solid area images from a wetted fuser surface and a smooth metal fuser surface creates difficulties not found in more conventional stripping operations. In a standard stripping situation the copy is removed by a peeling action of the stripping mechanism; that is, some part of the copy rides on the stripping ramp rather than on the forward portion of the stripper. This occurs when the adhesive forces of copy to substrate are sufficiently low so that the stripper, utilizing the beam strength of paper, can pry the copy off the roll without ever driving the very tip of the stripper finger into the interface.

As toner layer thickness and image coverage increase, the adhesion to fuser roll surface may become so large that, even with a stripping device which supports the copy over its entire width, paper beam strength is insufficient to remove the copy, and separation of the fused image must be accomplished by driving the knife edge into the toner-fuser interface.

The principle object of the invention is to provide a new and improved stripping apparatus for stripping copy sheets having high density or toner pile from pressure heated fusing rolls.

Another object of the invention is to improve the stripping of copy sheets from smooth metal fusing rolls to which copy sheets tend to stick or adhere to the fusing surface.

Still another object of the invention is to provide a stripping blade for stripping fused copy sheets from a fuser roll surface wherein the blade is capable of withstanding expanding forces.

Still another object of the invention is to minimize damage to copy sheets being stripped from a fusing surface without injuring the fusing surface.

Still another object of the present invention is to provide a new and improved stripping blade construction.

Other objects and advantages of the present invention will become apparent when read in conjunction with the accompanying drawings wherein.

Figure 1:
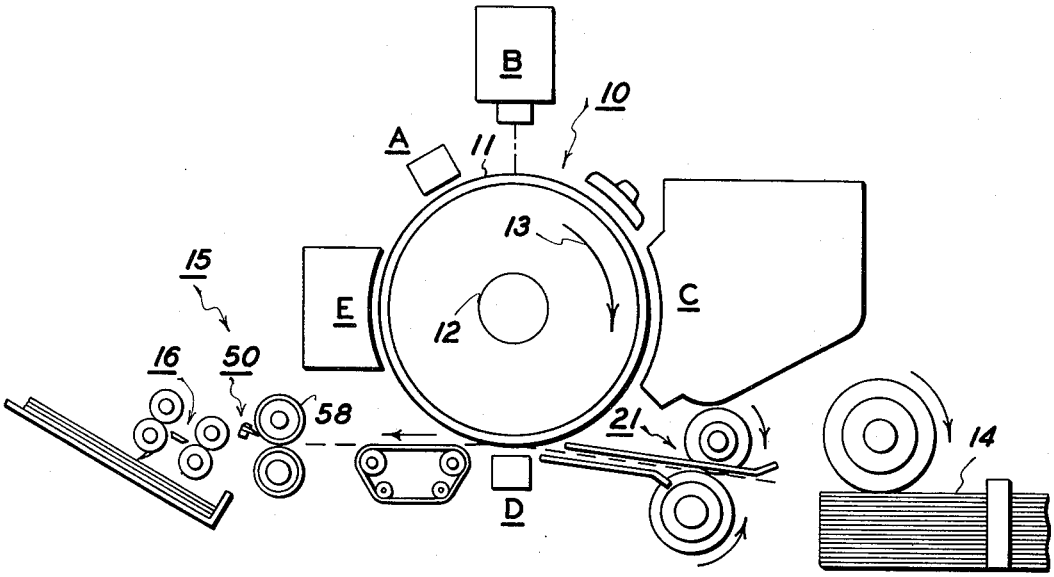
FIG. 1 is a schematic representation of a xerographic reproducing apparatus incorporating the stripping apparatus of the invention.

The reproducing machine illustrated in FIG. 1 employs an image recording drum member 10, the outer periphery of which is coated with a suitable photoconductive material 11. One type of photoconductive material is disclosed in U.S. Pat. No. 2,970,906 issued to Bixby in 1961. The drum 10 is suitably journaled for rotation within a machine frame (not shown) by means of a shaft 12 and rotates in the direction indicated by arrow 13, to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are herein represented in FIG. 1 as blocks A to E. Initially, the drum moves photoconductive surface 11 through a charging station A. At charging station A an electrostatic charge is placed uniformly over the photoconductive surface 11 of the drum 10 preparatory to imaging. The charging may be provided by a corona generating device of a type described in U.S. Pat. No. 2,836,725 issued to Vyverberg in 1958.

Thereafter, the drum 10 is rotated to exposure station B where the charged photoconductive surface 11 is exposed to a light image of the original input scene information, whereby the charge is selectively dissipated in the light exposure regions to record the original input scene in the form of a latent electrostatic image. A suitable exposure system amay be of the type described in U.S. patent application, Ser. No. 259,181 filed June 2, 1972 now U.S. Pat. No. 3,832,057, issued Aug. 27, 1974.

After exposure, drum 10 rotates the electrostatic latent image recorded on the photoconductive surface 11 to development station C, wherein a conventional developer mix is applied to the photoconductive surface 11 of the drum 10 rendering the latent image visible. A suitable development station is disclosed in U.S. patent application Ser. No. 199,481 filed Nov. 17, 1971 now a continuation application, Ser. No. 382,996, filed July 26, 1973. This application describes a magnetic brush development system utilizing a magnetizable developer mix having carrier granules and toner comprising electrophotographic resin plus colorant from dyes or pigments. A developer mix is continually brought through a directional flux field to form a brush thereof. The electrostatic latent image recorded on photoconductive surface 11 is developed by bringing the brush of developer mix into contact therewith. The developed image on the photoconductive surface 11 is then brought into contact with a sheet of final support material 14 within a transfer station D and the toner image is transferred from the photoconductive surface 11 to the contacting side of the final support sheet 14. The final support material may be plain paper, gummed labels, transparencies such as Polycarbonate, Polysulfane and Mylar, etc., as desired.

After the toner image has been transferred to the sheet of final support materil 14, the sheet with the image thereon is advanced to a suitable fuser assembly 15 which fuses the transfer powder image thereto. After the fusing process, the final support material 14 is advanced by a series of rolls 16 to a copy paper tray 17 for subsequent removal therefrom by a machine operator.

Although a preponderance of the toner powder is transferred to the final support material 14, invariably some residual toner remains on the photoconductive surface 11 after the transfer of the toner powder image to the final support material 14. The residual toner particles remaining on the photoconductive surface 11 after the transfer operation are removed from the drum 10 as it moves through cleaning station E. Here the residual toner particles are first brought under the influence of a cleaning corona generating device (not shown) adapted to neutralize the electrostatic charge remaining on the toner particles. The neutralized toner particles are then mechanically cleaned from the photoconductive surface 11 by conventional means, for example, the use of a resiliently biased knife blade as set forth in U.S. Pat. No. 3,660,863 issued to Gerbasi in 1972.

Figure 2:
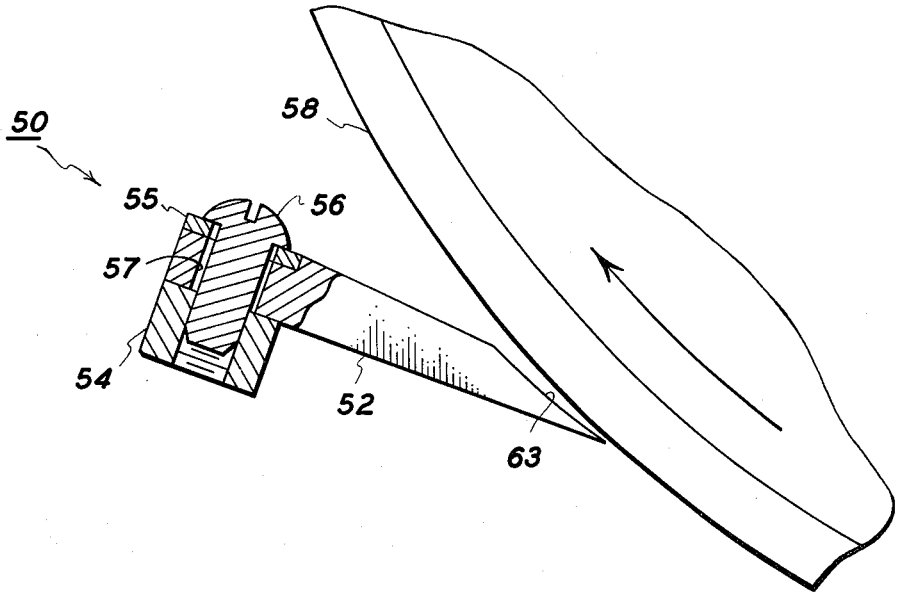
FIG. 2 is a fragmentary view of the stripping apparatus illustrating one embodiment of the invention.

Referring now to FIG. 2 there is shown a stripping apparatus 50 according to the present invention. Stripping apparatus 50 includes a blade member 52 positioned in close proximity to the fuser roll surface 58 on a blade retaining member 54 by screws 56. It will be noted that a shim 55 serves to clamp the blade member against retaining member 54. It will be further noted that blade member 52 has a slot 57 which is larger than the screw size to enable lateral expansion of the blade member axially relative to member 54 upon heating. Alternatively, a track could be used in place of a screw attachment. Blade retaining member 54 is loaded on a pivot axis by any suitable means such as a spring (not shown). Blade member 52 is longitudinally coextensive with the fuser roll surface and is sufficiently thin to be mounted securely in blade retaining member 54 to overcome any tendancy to warp. Desirably, blade member 52 is slightly longer than the copy sheet paper width so that no stripping demand is placed on the corners of the blade member. Also the blade member desirably is slightly shorter than the fuser roll surface to prevent uneven load distribution at the ends of the blade member.

In accordance with the invention the leading edge 62 of the blade member is hollow ground. This is to permit very good knife edge, a shallow stripping angle and the greatest possible knife edge strength. In other words, it is desirable that the extreme tip of the blade not deflect or lift away from the fuser roll surface upon application of the stripping pressure loads. It will be appreciated that the blade edge tip 62 is ground to a radius slightly larger than the fuser roll to accomplish the aforesaid purposes. In this manner the edge of the blade is sufficiently sharp for stripping solid area images having high toner pile images and yet is sufficiently strong so that it does not chip upon impact with higher toner pile images. It has been found that a blade knife angle approximately 20 to 30°with a tip 62 ground to a radius slightly larger than the fuser roll works well.

The material of the blade member must be tough enough to retain an acutely tapered knife edge. It must also be capable of sliding on a smooth surface without damaging the fuser roll surface to a degree which could affect copy quality or stripping. Further it should be able to withstand maximum continuous temperatures of approximately 330°F. Any suitable material can be used which will satisfy these conditions. It has been found that preferred metal is a graphite doped polymide manufactured by duPont Corporation of Wilmington, Delaware under the tradename of VESPEL.

It has been found that the blade member described above successfully strips even the most tightly sticking high pile toner images from the fuser roll surface. Further, more, the blade member described above strips without damaging fuser roll surface or the copy sheet being stripped.

Figure 3:
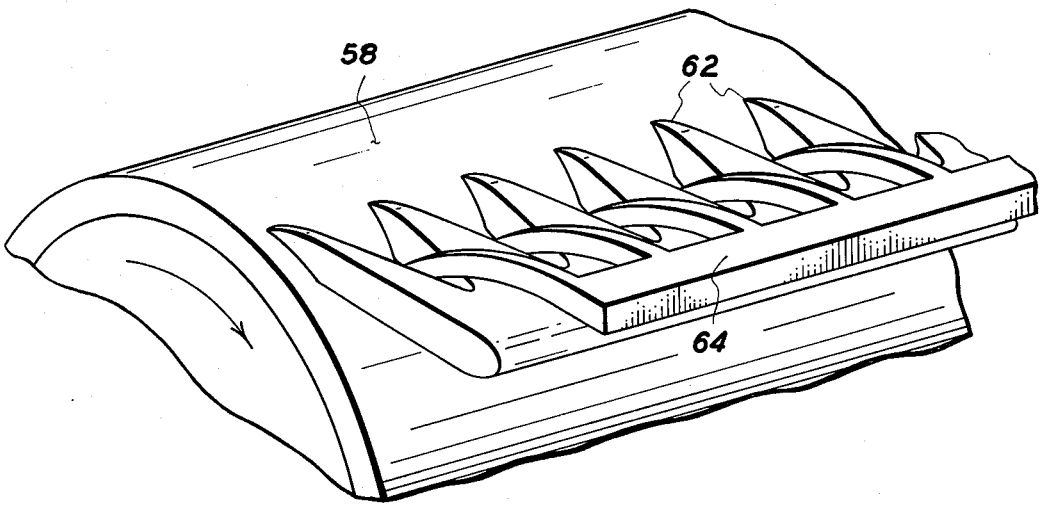
FIG. 3 is a fragmentary view of the stripping fingers illustrating still another embodiment of the invention.

FIG. 3 shows a second embodiment of the stripping apparatus wherein the blade member is arranged in a comb configuration. In this embodiment the blade member has spaced apart comb-like elements 62 which have interlocking tines extending from the blade retaining member 64. It will be appreciated that with this embodiment that sufficient stripping pressure is effected along the length of the copy sheet by stripping while allowing for lateral expansion of the spaced elements.

While there have been described and shown and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. In an apparatus for contact fusing toner particles to paper support material wherein said apparatus comprises fusing roll for applying heat and pressure to the particles and paper support material at a nip through which they are passed therethrough, an improved stripping apparatus for stripping sheets from the fuser roll surfaces comprising:

blade retaining means positioned in close proximity to a fuser roll surface from which copy sheets are to be stripped, a flexible blade member supported by said blade retaining means at an angle of about 20° to 30° to the fuser roll surface longitudinally coextensive therewith, said blade member having a hollow ground edge at the tip thereof of a radius slightly greater than the fuser roll surface, wherein said blade retaining means and blade member are arranged with inter-locking tines.

2. Apparatus according to claim 1 wherein said flexible blade member is made of a graphite doped polymide.

3. Apparatus according to claim 1 wherein said blade member is slideably positioned to move axially relative to said blade retaining means.

4. Apparatus according to claim 3 wherein said blade retaining means includes a plurality of screw members received through a shim member in contact with one side of said blade and on a retaining block in contact with the opposite side of said blade member.

5. Apparatus according to claim 4 wherein said blade member is formed with slotted openings through the screw members one received and which are larger than the screw members.

* * * * *